US007492906B2

(12) United States Patent
Matsuoka et al.

(10) Patent No.: US 7,492,906 B2
(45) Date of Patent: Feb. 17, 2009

(54) SPEAKER-CHARACTERISTIC METHOD AND SPEAKER REPRODUCTION SYSTEM

(75) Inventors: Bunkei Matsuoka, Tokyo (JP); Masaru Kimura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/582,862

(22) PCT Filed: Dec. 7, 2004

(86) PCT No.: PCT/JP2004/018186

§ 371 (c)(1),
(2), (4) Date: Jun. 14, 2006

(87) PCT Pub. No.: WO2005/062671

PCT Pub. Date: Jul. 7, 2005

(65) Prior Publication Data

US 2007/0098180 A1 May 3, 2007

(30) Foreign Application Priority Data

Dec. 24, 2003 (JP) ..... 2003-426501

(51) Int. Cl.
*H04R 5/00* (2006.01)

(52) U.S. Cl. ..... 381/17; 381/18; 381/19

(58) Field of Classification Search ..... 381/17, 381/18, 19, 20, 21, 1, 59; 455/575.1, 560
See application file for complete search history.

(56) References Cited

U.S. PATENT DOCUMENTS

| | | | | |
|---|---|---|---|---|
| 4,700,389 | A * | 10/1987 | Nakayama | 381/1 |
| 5,727,066 | A * | 3/1998 | Elliott et al. | 381/1 |
| 6,546,105 | B1 * | 4/2003 | Katayama et al. | 381/17 |
| 2003/0219130 | A1 * | 11/2003 | Baumgarte et al. | 381/17 |

FOREIGN PATENT DOCUMENTS

| | | | |
|---|---|---|---|
| JP | 09327099 | A | 12/1997 |
| JP | 2002-111817 | A | 4/2002 |
| JP | 2003-250199 | A | 9/2003 |
| JP | 2003-264895 | A | 9/2003 |
| JP | 2004-56403 | A | 2/2004 |
| JP | 2004-363717 | A | 12/2004 |

* cited by examiner

*Primary Examiner*—Vivian Chin
*Assistant Examiner*—George C Monikang
(74) *Attorney, Agent, or Firm*—Birch, Stewart, Kolasch & Birch, LLP

(57) ABSTRACT

To date, there has been no speaker-characteristic compensation method including a processing step of reducing crosstalk between speakers incorporated in a mobile terminal. Accordingly, it has been impossible to reduce crosstalk that, in a mobile terminal, occurs between speakers. A speaker-characteristic compensation method, for a mobile terminal device having at least two speakers in a case, according to the present invention includes steps of reducing mutual crosstalk between the speakers, thereby reducing crosstalk between the speakers.

24 Claims, 7 Drawing Sheets

SPEAKER-CHARACTERISTIC METHOD AND SPEAKER REPRODUCTION SYSTEM

BACKGROUND OF THE INVENTION

1. Technical Field

The present invention relates to a speaker-characteristic compensation method for reducing crosstalk between speakers incorporated in a mobile terminal device.

2. Background Art

Conventional crosstalk cancellers feature a filter in which, for the transfer function through which a virtual sound image corresponding to an input signal is supposed to reach the right ear or the left ear of the listener, a transfer function is convoluted for canceling crosstalk component that reach the right ear or the left ear of the listener.

Patent Literature 1: Japanese Laid-Open Patent Publication No. 1997-327099 (1 to 2 p)

Patent Literature 2: Japanese Laid-Open Patent Publication No. 2002-111817 (1 to 2 p, and 9-10 p)

DISCLOSURE OF THE INVENTION

To date, it has been a problem that, although, for the transfer function that corresponds to a space between a speaker and the listener, a filter exists in which a transfer function is convoluted for canceling crosstalk component that reach the right ear or the left ear of the listener, crosstalk between speakers within the case of a mobile terminal device is not appropriately reduced.

A speaker-characteristic compensation method, for a mobile terminal device having at least two speakers in a case, according to the present invention is configured in such a way as to include steps in which processing for reduction of crosstalk between the speakers is applied to input signals supplied to the speakers.

A speaker-characteristic compensation method, for a mobile terminal device having at least two speakers in a case, according to the present invention is configured in such a way as to include a step in which processing for reduction of crosstalk between the speakers is applied to input signals supplied to speakers, and can appropriately reduce crosstalk, between the speakers, within the case of the mobile terminal device.

BEST MODE FOR CARRYING OUT THE INVENTION

Embodiment 1

Figure 1:
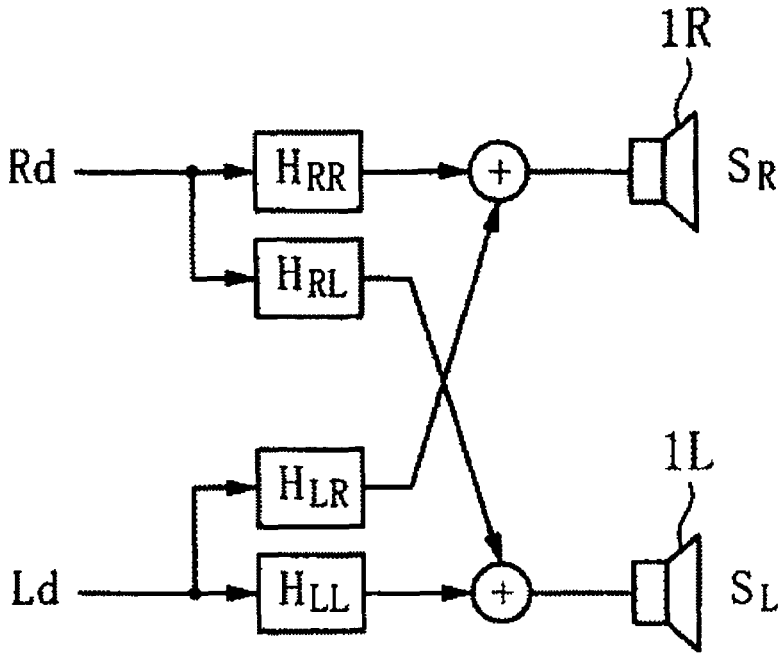
FIG. 1 is a diagram illustrating a reproduction model for a speaker reproduction system according to Embodiments 1 to 7.

The inventor's study proved that a phenomenon occurs that, in the case where a single back chamber is shared by two speakers so that a mobile terminal device is downsized, a sound wave reproduced by the one speaker leaks into the other speaker, due to inner-case acoustic coupling between the two speakers. FIG. 1 is a diagram with which the phenomenon is typified.

A first speaker 1R (the one speaker) and a second speaker 1L (the other speaker) illustrated in FIG. 1 are provided in an unillustrated mobile-terminal case and share a back chamber. As illustrated in FIG. 1, Reference Character $H_{LR}$ denotes transfer characteristic through which a driving signal Ld for driving the second speaker 1L is deformed, at least due to acoustic coupling within the case, and emitted from the first speaker 1R; Reference Character $H_{RL}$ denotes transfer characteristic through which a driving signal Rd for driving the first speaker 1R is deformed, at least due to acoustic coupling within the case, and emitted from the second speaker 1L. In addition, Reference Character $H_{RR}$ denotes transfer characteristic through which the driving signal Rd for driving the first speaker 1R is deformed, due to amplifier or speaker characteristic, and emitted from the first speaker 1R; Reference Character $H_{LL}$ denotes transfer characteristic through which the driving signal Ld for driving the second speaker. 1L is deformed, due to amplifier or speaker characteristic, and emitted from the second speaker 1L. Additionally, Reference Characters $S_R$ and $S_L$ denote speaker emission signals emitted from the first speaker 1R and the second speaker 1L, respectively, through the foregoing deformation.

As illustrated in FIG. 1, in the mobile terminal device in which inner-case acoustic coupling exists, the transfer characteristic $H_{RR}$ is applied to the driving signal Rd, and the driving signal Ld is acoustically coupled with the driving signal Rd, through the transfer characteristic $H_{LR}$. Both the driving signals are added to each other and emitted. In contrast, the transfer characteristic $H_{LL}$ is applied to the driving signal Ld, and the driving signal Rd is acoustically coupled with the driving signal Ld, through the transfer characteristic $H_{RL}$. Both the driving signals are added to each other and emitted. Accordingly, the speaker emission signals $S_R$ and $S_L$ that are emitted from the first and second speakers $S_R$ and $S_L$, respectively, can be given by Equation 1 below:

$$S_R = RdH_{RR} + LdH_{LR}$$

$$S_L = LdH_{LL} + RdH_{RL} \quad (1)$$

From Equation 1, it can be seen that the speaker emission signal $S_R$ includes the components of the driving signals Rd and Ld, and the speaker emission signal $S_L$ includes the components of the driving signals Ld and Rd. Equation 1 is given on condition that two or more speakers exist. That is why, in the case where inner-case acoustic coupling exists, the reproduced sound image becomes extremely narrow or reproduction with the sensation of being at live events cannot be realized even though a plurality of speakers is utilized for the reproduction.

Figure 2:
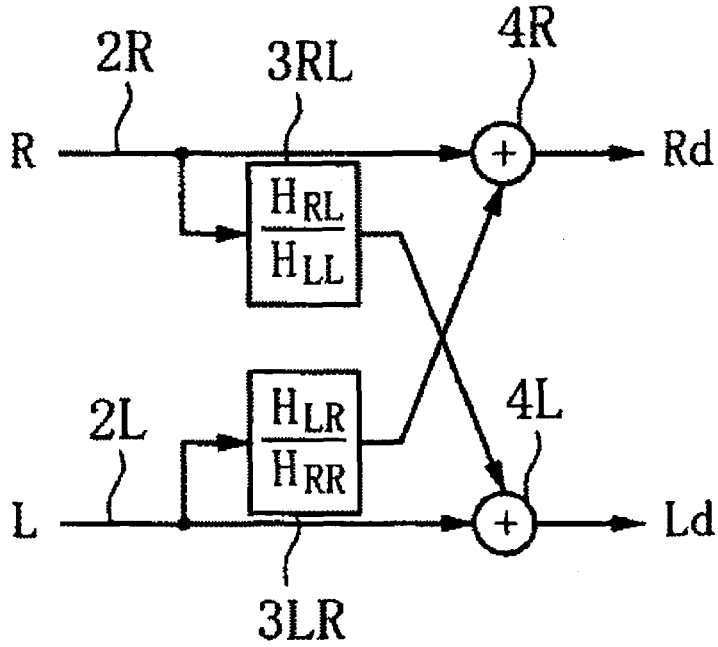
FIG. 2 is a conceptual diagram of a speaker-characteristic compensation circuit according to Embodiment 1.

The inventor paid his attention to the foregoing phenomenon and determined to reduce inter-case crosstalk between the speakers, by providing a speaker-characteristic compensation circuit illustrated in FIG. 2, at a stage before the reproduction system model illustrated in FIG. 1.

FIG. 2 is a schematic diagram of a speaker-characteristic compensation circuit utilized in a mobile terminal device according to Embodiment 1 of the present invention. As illustrated in FIG. 2, the speaker-characteristic compensation circuit according to Embodiment 1 includes a channel 2R for the first speaker 1R and a channel 2L for the second speaker 1L. Additionally, the speaker-characteristic compensation circuit includes a first processing device 3LR for processing an input signal L to the second speaker 1L to create a cross component for the first speaker 1R, and a first addition device 4R for adding the output signal from the first processing device 3LR to an input signal R that is a direct component for the first speaker 1R, thereby outputting the driving signal Rd. Similarly, the speaker-characteristic compensation circuit includes a second processing device 3RL for processing the input signal R to the first speaker 1R to create a cross component for the second speaker 1L, and a second addition device 4L for adding the output signal from the second processing device 3RL to the input signal L that is a direct component for the second speaker 1L, thereby outputting the driving signal Ld.

In Embodiment 1, the driving signals Rd and Ld that are outputted from the first and second addition devices 4R and 4L, respectively, are utilized as the driving signals Rd and Ld explained with reference to FIG. 1. In addition, in Embodiment 1, the respective outputs (cross components) from the first and second processing devices 3LR and 3RL correspond to reduction signals for reducing sounds that leak into from one speaker to the other speaker.

Next, the operation of the speaker-characteristic compensation circuit will be explained. The input signal R inputted to the mobile terminal device according to the present invention is divided into two signals; one of the signals is inputted to the second processing device 3RL, and the other is inputted, as a direct component, to the first addition device 4R. Similarly, the input signal L inputted to the mobile terminal device according to the present invention is divided into two signals; one of the signals is inputted to the first processing device 3LR, and the other is inputted, as a direct component, to the second addition device 4L.

The input signal L inputted to the first processing device 3LR passes through a filter having characteristic of, e.g., −HLR/HRR and is inputted to the first addition device 4R. The first addition device 4R adds the output signal (cross component) from the first processing device 3LR to the input signal R (direct component), thereby creating the driving signal Rd. Similarly, the input signal R inputted to the first processing device 3RL passes through a filter having characteristic of, e.g., −HRL/HLL and is inputted to the second addition device 4L. The second addition device 4L adds the output signal (cross component) from the second processing device 3RL to the input signal L (direct component), thereby creating the driving signal Ld.

As can be seen from FIG. 1, when the driving signals Rd and Ld that have been created through the foregoing processing instances drive the first and second speakers 1R and 1L, respectively, the speaker emission signal $S_R$ emitted from the first speaker 1R is given by Equation 2:

$$\begin{aligned} S_R &= RdH_{RR} + LdH_{LR} \\ &= \left(R - L\frac{H_{LR}}{H_{RR}}\right)H_{RR} + \left(L - R\frac{H_{RL}}{H_{LL}}\right)H_{LR} \end{aligned} \tag{2}$$

-continued $$\begin{aligned} &= RH_{RR} - R\frac{H_{RL}}{H_{LL}}H_{LR} - LH_{LR} + LH_{LR} \\ &= R\left(H_{RR} - \frac{H_{RL}H_{LR}}{H_{LL}}\right) \end{aligned}$$

Additionally, the speaker emission signal $S_L$ emitted from the second speaker 1L is given by Equation 3:

$$\begin{aligned} S_L &= LdH_{LL} + RdH_{RL} \\ &= \left(L - R\frac{H_{RL}}{H_{LL}}\right)H_{LL} + \left(R - L\frac{H_{LR}}{H_{RR}}\right)H_{RL} \\ &= LH_{LL} - L\frac{H_{LR}}{H_{RR}}H_{RL} - RH_{RL} + LH_{RL} \\ &= L\left(H_{LL} - \frac{H_{LR}H_{RL}}{H_{RR}}\right) \end{aligned} \tag{3}$$

In consequence, it can be seen that, with regard to the speaker emission signals $S_R$ and $S_L$, only the R-input-signal component and the L-input-signal component are emitted, respectively, and either signal component intended for the other speaker is cancelled. In other words, according to Embodiment 1, a signal can be reproduced for which inner-case acoustic coupling is cancelled, whereby an effect in which speaker separation can be enhanced can be demonstrated.

In addition, according to Embodiment 1, a case has been explained in which a reduction signal for reducing a sound that, within a device case, leaks from one speaker into the other speaker is obtained by processing an input signal to the other speaker. However, the present invention is not limited to the foregoing method, but an arbitrary creation method for the reduction signal may be employed. The reduction signal may be produced by processing a separately created signal.

In the case where the transfer characteristics HRL and HLR are equal to each other or approximate each other enough to be regarded as equal, and such is the case with the transfer characteristics HRR and HLL, it is possible to assume that HLR=HRL=HX, and HRR=HLL=HD. In this case, the transfer characteristics of the first and second processing devices 3LR and 3RL can be given by −HX/HD. Additionally, the speaker emission signals $S_R$ and $S_L$ emitted from the first and second speakers 1R and 1L are given by Equations 4 and 5, respectively.

$$\begin{aligned} S_R &= RdH_D + LdH_X \\ &= \left(R - L\frac{H_X}{H_D}\right)H_D + \left(L - R\frac{H_X}{H_D}\right)H_X \\ &= RH_D - LH_X + LH_X - R\frac{H_X}{H_D}H_X \\ &= R\left(H_D - \frac{H_X^2}{H_D}\right) \end{aligned} \tag{4}$$

-continued $$S_L = LdH_D + RdH_X \tag{5}$$
$$= \left(L - R\frac{H_X}{H_D}\right)H_D + \left(R - L\frac{H_X}{H_D}\right)H_X$$
$$= LH_D - RH_X + RH_X - L\frac{H_X}{H_D}H_X$$
$$= L\left(H_D - \frac{H_X^2}{H_D}\right)$$

Accordingly, for example, in the case where two speakers are arranged, in a case, bilaterally symmetric or vertically symmetric with each other, making the processing devices 3 equal can demonstrate an effect in which production costs of signal processing devices are reduced.

In addition, in Embodiment 1 of the present invention, a speaker-characteristic compensation method in the case of a mobile device with two input channels and two reproduction speakers has been explained. However, the speaker-characteristic compensation method is not limited to a mobile device with two input channels and two reproduction speakers, but can be applied also to a mobile device with N (N is 3 or more) speakers.

Additionally, in some cases, the transfer characteristics HLR and HRL include speaker characteristics in addition to inner-case acoustic coupling.

Embodiment 2

In Embodiment 1, for processing steps to reduce crosstalks, the first and second processing devices 3LR and 3RL are utilized; however, in Embodiment 2, a case will be explained in which first and direct processing devices 5RR and 5LL, and first and second cross processing device 6LR and 6RL, which are described later, are utilized. The phenomenon that a sound wave reproduced by one speaker leaks into the other speaker, due to inner-case acoustic coupling, is similar to the phenomenon illustrated FIG. 1 in Embodiment 1; therefore, explanation for that will be omitted here.

Figure 3:
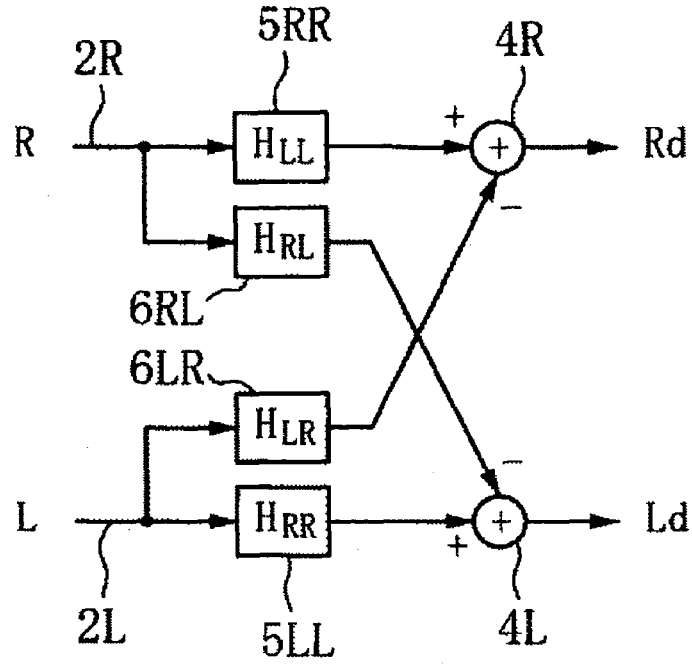
FIG. 3 is a conceptual diagram of a speaker-characteristic compensation circuit according to Embodiment 2.

FIG. 3 is a schematic diagram of a speaker-characteristic compensation circuit utilized in a mobile terminal device according to Embodiment 2 of the present invention. As illustrated in FIG. 3, the speaker-characteristic compensation circuit according to Embodiment 2 includes a channel 2R for the first speaker 1R and a channel 2L for the second speaker 1L. Additionally, the speaker-characteristic compensation circuit includes a first direct processing device 5RR for processing an input signal R to the first speaker 1R to create a direct component for the first speaker 1R, a first cross processing device 6LR for processing an input signal L to the second speaker 1L to create a cross component for the first speaker 1R, and the first addition device 4R for adding the signals created through both the processing instances, thereby outputting a driving signal Rd. Similarly, the speaker-characteristic compensation circuit includes a second direct processing device 5LL for processing an input signal L to the second speaker 1L to create a direct component for the second speaker 1L, a second cross processing device 6RL for processing an input signal R to the second speaker 1R to create a cross component for the second speaker 1L, and the second addition device 4L for adding the signals created through both the processing instances, thereby outputting a driving signal Ld.

Next, the operation of the speaker-characteristic compensation circuit will be explained. The input signal R inputted to the mobile terminal device according to the present invention is divided into two signals; one of the signals is inputted to the second cross processing device 6RL, and the other is inputted to the first direct processing device 5RR. Similarly, the input signal L inputted to the mobile terminal device according to the present invention is divided into two signals; one of the signals is inputted to the first cross processing device 6LR, and the other is inputted to the second direct processing device 5LL.

The input signal L inputted to the first cross processing device 6LR passes through a filter having characteristic of, e.g., −HLR and is inputted to the first addition device 4R. The input signal R inputted to the first direct processing device 5RR passes through a filter having characteristic of, e.g., HLL and is inputted to the first addition device 4R. The first addition device 4R creates the driving signal Rd. Similarly, the input signal R inputted to the second cross processing device 6RL passes through a filter having characteristic of, e.g., −HRL and is inputted to the second addition device 4L. The input signal L inputted to the second direct processing device 5LL passes through a filter having characteristic of, e.g., HRR and is inputted to the second addition device 4L. The second addition device 4L creates the driving signal Ld.

As can be seen from FIG. 1, when the driving signals Rd and Ld that have been created through the foregoing processing instances drive the first and second speakers 1R and 1L, respectively, a speaker emission signal $S_R$ emitted from the speaker 1R is given by Equation 6:

$$S_R = RdH_{RR} + LdH_{LR} \tag{6}$$
$$= (RH_{LL} - LH_{LR})H_{RR} + (LH_{RR} - RH_{RL})H_{LR}$$
$$= R(H_{LL}H_{RR} - H_{RL}H_{LR}) - L(H_{LR}H_{RR} - H_{RR}H_{LR})$$
$$= R(H_{LL}H_{RR} - H_{RL}H_{LR})$$

Additionally, a speaker emission signal $S_L$ emitted from the second speaker 1L is given by Equation 7:

$$S_L = LdH_{LL} + RdH_{RL} \tag{7}$$
$$= (LH_{RR} - RH_{RL})H_{LL} + (RH_{LL} - LH_{LR})H_{RL}$$
$$= L(H_{RR}H_{LL} - H_{LR}H_{RL}) - R(H_{RL}H_{LL} - H_{LL}H_{RL})$$
$$= L(H_{RR}H_{LL} - H_{LR}H_{RL})$$

In consequence, it can be seen that, with regard to the speaker emission signals $S_R$ and $S_L$, only the R-input-signal component and the L-input-signal component are emitted, respectively, and either signal component intended for the other speaker is cancelled. In other words, according to Embodiment 2, a signal can be reproduced for which inner-case acoustic coupling is cancelled, whereby an effect in which speaker separation can be enhanced can be demonstrated.

Moreover, compared with Embodiment 1, in the case of Embodiment 2, an effect is demonstrated in which the respective amplitudes and phases of the left and right sounds reproduced through the speaker emission signal $S_L$ from the first speaker 1L and the speaker emission signal $S_R$ from the second speaker 1R, respectively, can be maintained relative to the corresponding left and right input signals to the speakers.

In the case where the transfer characteristics HRL and HLR are equal to each other or approximate each other enough to be regarded as equal, and such is the case with the transfer characteristics HRR and HLL, it is possible to assume that HLR=HRL=HX, and HRR=HLL=HD. Accordingly, the transfer characteristics of the first direct processing device 5RR and the second direct processing device 5LL can be given by HD. Similarly, the transfer characteristics of the first cross processing device 6LR and the second cross processing device 6RL can be given by −HX.

In this case, the speaker emission signals $S_R$ and $S_L$ emitted from the first and second speakers 1R and 1L are given by Equations 8 and 9, respectively.

$$\begin{aligned} S_R &= RdH_D + LdH_X \\ &= (RH_D - LH_X)H_D + (LH_D - RH_X)H_X \\ &= RH_D^2 - LH_X H_D + LH_D H_X - RH_X^2 \\ &= R(H_D^2 - H_X^2) \end{aligned} \tag{8}$$

$$\begin{aligned} S_L &= LdH_D + RdH_X \\ &= (LH_D - RH_X)H_D + (RH_D - LH_X)H_X \\ &= LH_D^2 - RH_X H_D + RH_D H_X - LH_X^2 \\ &= L(H_D^2 - H_X^2) \end{aligned} \tag{9}$$

Accordingly, for example, in the case where two speakers are arranged, in a case, bilaterally symmetric or vertically symmetric with each other, making the direct processing devices 5 or the cross processing devices 6 equal can demonstrate an effect in which production costs of signal processing devices are reduced.

In addition, in Embodiment 2, constituent elements the same as or equivalent to those in Embodiment 1 of the present invention are denoted by the same reference characters, and explanations for those are omitted; thus, only different elements have been explained.

Embodiment 3

In Embodiment 2, for processing steps to reduce crosstalks, the first and second direct processing devices 5RR and 5LL, and the first and second cross processing devices 6LR and 6RL are utilized; however, in Embodiment 3, a case will be explained in which first and second post-processing devices 7RR and 7LL, which are described later, are further utilized so that the respective speaker emission signals coincide with corresponding speaker input signals in amplitude and phase.

The phenomenon that a sound wave reproduced by one speaker leaks into the other speaker, due to inner-case acoustic coupling, is similar to the phenomenon illustrated FIG. 1 in Embodiment 1; therefore, explanation for that will be omitted here.

Additionally, the first and second direct processing devices 5RR and 5LL, and the first and second cross processing devices 6LR and 6RL are the same as those in FIG. 3 in Embodiment 2; therefore, explanations for those will be omitted here.

Figure 4:
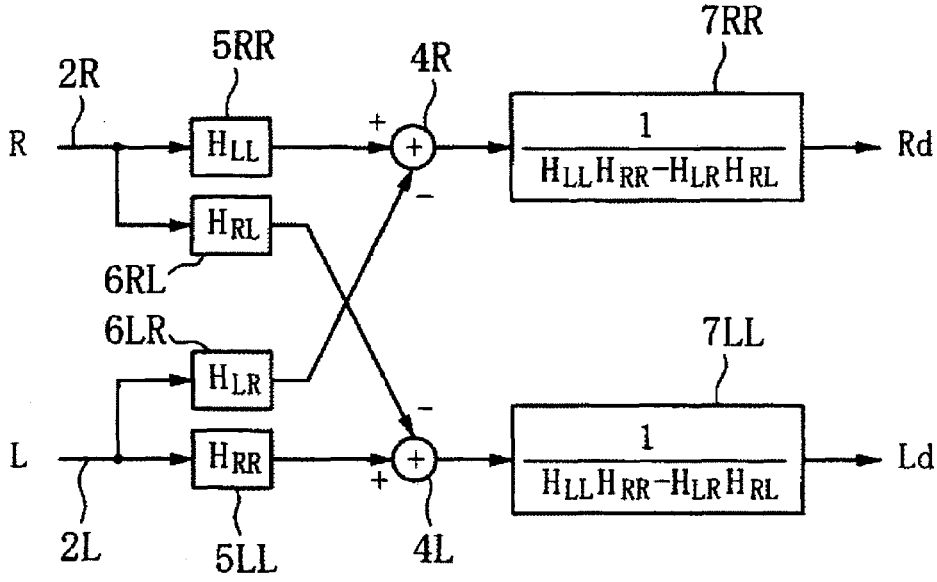
FIG. 4 is a conceptual diagram of a speaker-characteristic compensation circuit according to Embodiment 3.

FIG. 4 is a schematic diagram of a speaker-characteristic compensation circuit utilized in a mobile terminal device according to Embodiment 3 of the present invention. As illustrated in FIG. 4, the speaker-characteristic compensation circuit according to Embodiment 3 includes the first post-processing device 7RR for further processing a signal obtained by addition in the first addition device 4R to create a driving signal Rd for driving the first speaker 1R and the second post-processing device 7LL for further processing a signal obtained by addition in the second addition device 4L to create a driving signal Ld for driving the second speaker 1L, in addition to the first and second direct processing devices 5RR and 5LL and the first and second cross processing devices 6LR and 6RL, described in Embodiment 2. In Embodiment 3, the driving signals Rd and Ld that are outputted from the first and second post-processing devices 7RR and 7LL, respectively, are utilized as the driving signals Rd and Ld explained with reference to FIG. 1.

Next, the operation of the speaker-characteristic compensation circuit according to Embodiment 3 will be explained. The signal obtained by addition in the first addition device 4R is inputted the first post-processing device 7RR. The signal inputted to the first post-processing device 7RR passes through a filter having characteristic of, e.g., 1/(HLL·HRR−HLR·HRL), whereby the driving signal Rd is created. Similarly, the signal obtained by addition in the second addition device 4L is inputted the second post-processing device 7LL. The signal inputted to the second post-processing device 7LL passes through a filter having characteristic of, e.g., 1/(HLL·HRR−HLR·HRL), whereby the driving signal Ld is created.

As can be seen from FIG. 1, when the driving signals Rd and Ld that have been created through the foregoing processing instances drive the first and second speakers 1R and 1L, respectively, a speaker emission signal $S_R$ emitted from the speaker 1R is given by Equation 10:

$$\begin{aligned} S_R &= RdH_{RR} + LdH_{LR} \\ &= \left(R\frac{H_{LL}}{H_{LL}H_{RR} - H_{LR}H_{RL}} - L\frac{H_{LR}}{H_{LL}H_{RR} - H_{LR}H_{RL}}\right)H_{RR} + \\ &\quad \left(L\frac{H_{RR}}{H_{LL}H_{RR} - H_{LR}H_{RL}} - R\frac{H_{RL}}{H_{LL}H_{RR} - H_{LR}H_{RL}}\right)H_{LR} \\ &= \frac{1}{H_{LL}H_{RR} - H_{LR}H_{RL}}(R(H_{LL}H_{RR} - H_{RL}H_{LR}) - \\ &\quad L(H_{LR}H_{RR} - H_{RR}H_{LR})) \\ &= R \end{aligned} \tag{10}$$

Additionally, a speaker emission signal $S_L$ emitted from the second speaker 1L is given by Equation 11:

$$\begin{aligned} S_L &= LdH_{LL} + RdH_{RL} \\ &= \left(L\frac{H_{RR}}{H_{LL}H_{RR} - H_{LR}H_{RL}} - R\frac{H_{RL}}{H_{LL}H_{RR} - H_{LR}H_{RL}}\right)H_{LL} + \\ &\quad \left(R\frac{H_{LL}}{H_{LL}H_{RR} - H_{LR}H_{RL}} - L\frac{H_{LR}}{H_{LL}H_{RR} - H_{LR}H_{RL}}\right)H_{RL} \\ &= \frac{1}{H_{LL}H_{RR} - H_{LR}H_{RL}}(L(H_{RR}H_{LL} - H_{LR}H_{RL}) - \\ &\quad R(H_{RL}H_{LL} - H_{LL}H_{RL})) \\ &= L \end{aligned} \tag{11}$$

In consequence, it can be seen that, with regard to the speaker emission signals $S_R$ and $S_L$, only the R-input-signal component and the L-input-signal component are emitted, respectively, and either signal component intended for the other speaker is cancelled. In other words, according to Embodiment 1, a signal can be reproduced for which inner-case acoustic coupling is cancelled, whereby an effect in which speaker separation can be enhanced can be demonstrated.

Moreover, compared with any one of Embodiments 1 and 2, in the case of Embodiment 3, effects of speaker characteristics and inner-case acoustic coupling can be cancelled further completely. In other words, the respective speaker output signals can approximately coincide with corresponding speaker input signals in amplitude or phase.

In the case where the transfer characteristics HRL and HLR are equal to each other or approximate each other enough to be regarded as equal, and such is the case with the transfer characteristics HRR and HLL, it is possible to assume that HLR=HRL=HX, and HRR=HLL=HD. Accordingly, the transfer characteristics of the first post-processing device 7RR and the second post-processing device 7LL can be given by $1/(HD^2-HX^2)$. Analogously, in this case, the speaker emission signals $S_R$ and $S_L$ emitted from the first and second speakers 1R and 1L are given by Equations 12 and 13, respectively.

$$\begin{aligned} S_R &= RdH_D + LdH_X \\ &= \left(R\frac{H_D}{H_D^2 - H_X^2} - L\frac{H_X}{H_D^2 - H_X^2}\right)H_D + \\ &\quad \left(L\frac{H_D}{H_D^2 - H_X^2} - R\frac{H_X}{H_D^2 - H_X^2}\right)H_X \\ &= \frac{1}{H_D^2 - H_X^2}(R(H_D^2 - H_X^2) - L(H_X H_D - H_D H_X)) \\ &= R \end{aligned} \tag{12}$$

$$\begin{aligned} S_L &= LdH_D + RdH_X \\ &= \left(L\frac{H_D}{H_D^2 - H_X^2} - R\frac{H_X}{H_D^2 - H_X^2}\right)H_D + \\ &\quad \left(R\frac{H_D}{H_D^2 - H_X^2} - L\frac{H_X}{H_D^2 - H_X^2}\right)H_X \\ &= \frac{1}{H_D^2 - H_X^2}(L(H_D^2 - H_X^2) - R(H_X H_D - H_D H_X)) \\ &= L \end{aligned} \tag{13}$$

Accordingly, for example, in the case where two speakers are arranged, in a case, bilaterally symmetric or vertically symmetric with each other, making the post-processing devices 7 equal can demonstrate an effect in which production costs of signal processing devices are reduced.

In addition, in Embodiment 3, constituent elements the same as or equivalent to those in Embodiments 1 and 2 of the present invention are denoted by the same reference characters, and explanations for those are omitted; thus, only different elements have been explained.

Additionally, Embodiment 3 has been explained on the assumption that the first and second post-processing devices 7RR and 7LL are arranged after the first and second direct processing devices 5RR and 5LL, respectively, and the first and second cross processing devices 6LR and 6RL, respectively. However, the present invention is not limited to the foregoing arrangement; two pre-processing devices may be arranged before the first and second direct processing devices 5RR and 5LL, respectively, and the first and second cross processing devices 6LR and 6RL, respectively, and may implement processing so that the respective speaker emission signals approximately coincide with the corresponding speaker input signals in amplitude and phase.

Embodiment 4

In Embodiment 1, for processing steps to reduce crosstalks, the first and second processing devices 3LR and 3RL are utilized; however, in Embodiment 4, a case will be explained in which first and second multiplication processing devices 8LR and 8RL, which are described later, are utilized.

In addition, the phenomenon that a sound wave reproduced by one speaker leaks into the other speaker, due to inner-case acoustic coupling, is similar to the phenomenon illustrated FIG. 1 in Embodiment 1; therefore, explanation for that will be omitted here.

Figure 5:
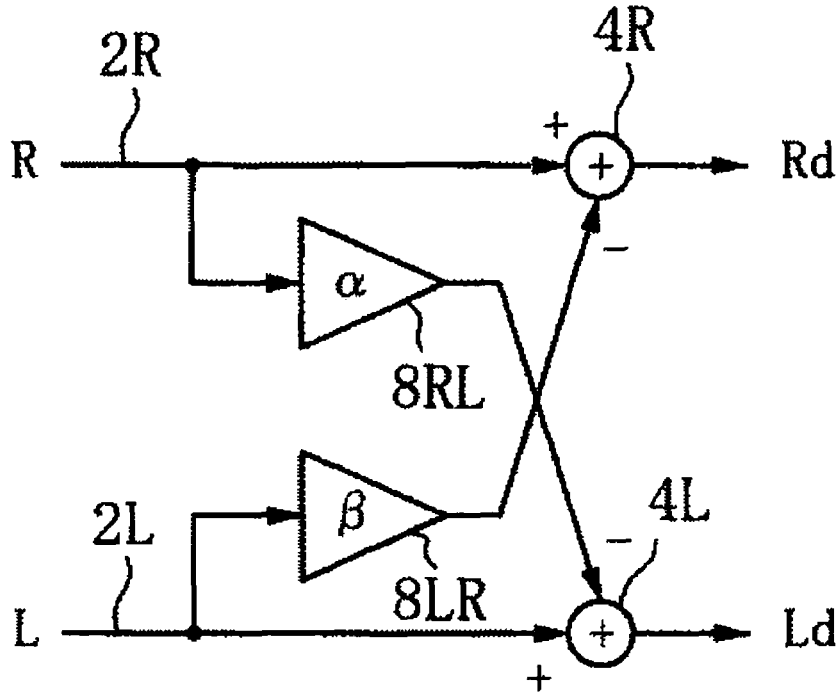
FIG. 5 is a conceptual diagram of a speaker-characteristic compensation circuit according to Embodiment 4.

FIG. 5 is a schematic diagram of a speaker-characteristic compensation circuit utilized in a mobile terminal device according to Embodiment 4 of the present invention. As illustrated in FIG. 5, the speaker-characteristic compensation circuit according to Embodiment 4 includes the first multiplication processing device 8LR for processing an input signal L to the second speaker 1L to create a cross component for the first speaker 1R and the second multiplication processing device 8RL for processing an input signal R to the first speaker 1R to create a cross component for the second speaker 1L.

Next, the operation of the speaker-characteristic compensation circuit will be explained. The input signal R inputted to the mobile terminal device according to the present invention is divided into two signals; one of the signals is inputted to the second multiplication processing device 8RL, and the other is inputted, as a direct component, to the first addition device 4R. Analogously, the input signal L inputted to the mobile terminal device according to the present invention is divided into two signals; one of the signals is inputted to the first multiplication processing device 8LR, and the other is inputted, as a direct component, to the second addition device 4L.

The input signal L inputted to the first multiplication processing device 8LR passes through a filter having a characteristic that implements multiplication by a scalar value β of less than one to reverse a sign and is inputted to the first addition device 4R. The first addition device 4R adds the output signal from the first multiplication processing device 8LR to the input signal R, thereby creating the driving signal Rd. Similarly, the input signal R inputted to the second multiplication processing device 8RL passes through a filter having a characteristic that implements multiplication by, for example, a scalar value α of less than one to reverse a sign and is inputted to the second addition device 4L. The second addition device 4L adds the output signal from the second multiplication processing device 8RL to the input signal L, thereby creating the driving signal Ld.

As can be seen from FIG. 1, when the driving signals Rd and Ld drive the first and second speakers 1R and 1L, respectively, the speaker emission signal $S_R$ emitted from the speaker 1R is given by Equation 14:

$$\begin{aligned} S_R &= RdH_{RR} + LdH_{LR} \\ &= (R - \beta L)H_{RR} + (L - \alpha R)H_{LR} \\ &= R(H_{RR} - \alpha H_{LR}) - L(\beta H_{RR} - H_{LR}) \end{aligned} \tag{14}$$

Additionally, a speaker emission signal $S_L$ emitted from the second speaker 1L is given by Equation 15:

$$\begin{aligned} S_L &= LdH_{LL} + RdH_{RL} \\ &= (L - \alpha R)H_{LL} + (R - \beta L)H_{RL} \\ &= L(H_{LL} - \beta H_{RL}) - R(\alpha H_{LL} - H_{RL}) \end{aligned} \tag{15}$$

Next, the optimal value of the coefficient β to be utilized in the first multiplication processing device 8LR is decided. In other words, in order to enhance the separation between the speaker emission signal $S_R$ from the first speaker 1R and the input signal L to the second speaker 1L, the value of the coefficient β may be decided in such away that the value of (βHRR−HLR) makes closest to zero. Accordingly, the optimal coefficient value β* is given by Equation 16.

$$\beta^* = \arg\min_{\beta} |(\beta H_{RR} - H_{LR})| \tag{16}$$

It can be seen that, in the first multiplication processing device 8LR, multiplication of the input signal L and the optimal coefficient value β* enables emission of only the R component, for the driving signal Rd, and the other signal component (the L component) is cancelled or reduced. Analogously, the optimal value of the coefficient α to be utilized in the second multiplication processing device 8RL is decided. In other words, in order to enhance the separation between the speaker emission signal $S_L$ from the second speaker 1L and the input signal R to the first speaker 1R, the value of the coefficient α may be chosen that makes the value of (αHLL−HRL) closest to zero. Accordingly, the optimal coefficient value α* is given by Equation 17.

$$\alpha^* = \arg\min_{\alpha} |(\alpha H_{LL} - H_{RL})| \tag{17}$$

It can be seen that, in the second multiplication processing device 8RL, multiplication of the input signal R and the optimal coefficient value α* enables emission of only the L component, for the driving signal Ld, and the other signal component (the R component) is cancelled or reduced.

As described above, by deciding α* and β* and utilizing α* and β* in the first and second multiplication processing devices 8LR and 8RL, a signal can be reproduced for which in-case acoustic coupling is cancelled, whereby an effect in which speaker separation can be enhanced can be demonstrated.

Moreover, the costs of producing the foregoing multiplication processing devices 8 are low, whereby an effect in which the speaker characteristic compensation can be realized at low cost is demonstrated.

In addition, in Embodiment 4, constituent elements the same as or equivalent to those in Embodiment 1 of the present invention are denoted by the same reference characters, and explanations for those are omitted; thus, only different elements have been explained.

Embodiment 5

In Embodiment 1, for processing steps to reduce crosstalks, the first and second processing devices 3LR and 3RL are utilized; however, in Embodiment 5, a case will be explained in which first and second subband division devices 9LR and 9RL, first and second subband processing devices 10LR and 10RL, first and second subband synthesis devices 11LR and 11RL, which are described later, are utilized.

In addition, the phenomenon that a sound wave reproduced by one speaker leaks into the other speaker, due to inner-case acoustic coupling, is similar to the phenomenon illustrated FIG. 1 in Embodiment 1; therefore, explanation for that will be omitted here. Additionally, the respective additions in the first and second addition devices 4R and 4L are the same as those in Embodiment 1; therefore, explanations for those are omitted here.

Figure 6:
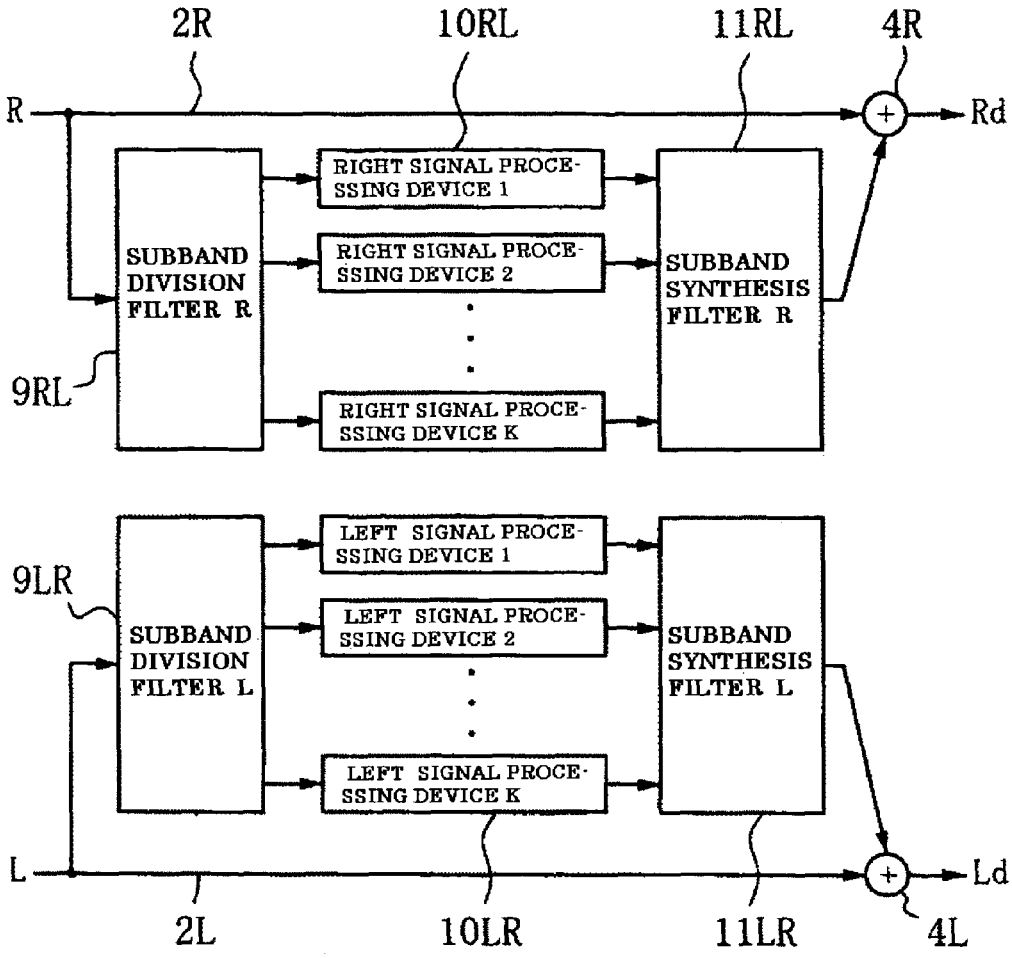
FIG. 6 is a conceptual diagram of a speaker-characteristic compensation circuit according to Embodiment 5.

FIG. 6 is a schematic diagram of a speaker-characteristic compensation circuit/utilized in a mobile terminal device according to Embodiment 5 of the present invention. As illustrated in FIG. 6, the speaker-characteristic compensation circuit according to Embodiment 5 includes the first subband division device 9LR, the first subband processing device 10LR, and the first subband synthesis device 11LR for processing an input signal L to the second speaker 1L to create a cross component for the first speaker 1R, and the second subband division device 9RL, the second subband processing device 10RL, and the second subband synthesis device 11RL for processing an input signal R to the first speaker 1R to create a cross component for the first speaker 1R.

Next, the operation of the speaker-characteristic compensation circuit will be explained. The input signal L to the second speaker 1L is inputted to the second adder 4L and to the first subband division device 9LR. The subband division device 9LR divides the input signal L into K subbands, based on the frequencies. Let the signals obtained through the division by the subband division device 9LR be denoted by signals L1, L2, to LK, in the order of band frequency. The signal L1 is inputted to the first subband processing device 10LR1. The signal L2 is inputted to the first subband processing device 10LR2; the signals up to LK are each inputted to the corresponding first subband processing device 10LRj (j=1, 2, to K). The first subband processing device 10LRj processes the inputted signal Lj and outputs the resultant signal. For instance, the inputted signal Lj is processed with a characteristic that is a portion, extracted from the characteristic of −HLR/HRR, that corresponds to the bandwidth j. Moreover, the signal Lj receives processing of adding a characteristic multiplied by a coefficient γj. The processed output signals from the first subband processing device 10LRj are synthesized by the first subband synthesis device 11LR and the resultant signal is inputted to the first addition device 4R. The first addition device 4R adds the output signal from the first subband synthesis device 11LR to the input signal R to the first speaker 1R, thereby outputting a driving signal Rd for driving the first speaker 1R.

Similarly, the input signal R to the first speaker 1R is inputted to the first adder 4R and to the second subband division device 9RL. The subband division device 9RL divides the input signal R into K subbands, based on the frequencies. Let the signals obtained through the division by the subband division device 9RL be denoted by signals R1, R2, to RK, in the order of band frequency. The signal R1 is inputted to the second subband processing device 10RL1. The signal R2 is inputted to the second subband processing device 10RL2; the signals up to RK are each inputted to the corresponding second subband processing device 10RLj (j=1, 2, to K). The second subband processing device 10RLj processes the inputted signal Rj and outputs the resultant signal. For instance, the inputted signal Rj is processed with a characteristic that is a portion, extracted from the characteristic of −HRL/HLL, that corresponds to the bandwidth j. Moreover, the signal Rj receives processing of adding a characteristic multiplied by a coefficient γj. The processed output signals from the second subband processing device 10RLj are synthesized by the second subband synthesis device 11RL and the resultant signal is inputted to the second addition device 4L. The second addition device 4L adds the output signal from the second subband synthesis device 11RL to the input signal L to the second speaker 1L, thereby outputting a driving signal Ld for driving the second speaker 1L.

In the foregoing processing, by, for all the bandwidths, setting the coefficient γj to one, an effect the same as that in Embodiment 1 can be demonstrated. By changing the coefficient γj, the degree of processing can be changed for each bandwidth; for example, by setting the coefficient γj for the low-frequency band larger, the low-frequency signal components of the output signal can be enhanced.

In addition, in Embodiment 5, constituent elements the same as or equivalent to those in Embodiment 1 described above are denoted by the same reference characters, and explanations for those are omitted; thus, only different elements have been explained.

Embodiment 6

In Embodiment 1, for processing steps to reduce crosstalks, the first and second processing devices 3LR and 3RL are utilized; however, in Embodiment 6, a case will be explained in which unillustrated first and second low-pass devices, which are described later, are utilized. In addition, Embodiment 6 is the same as Embodiment 1, except that, in FIG. 2, the first and second processing devices 3LR and 3RL are replaced by the first and second low-pass devices.

Additionally, the phenomenon that a sound wave reproduced by one speaker leaks into the other speaker, due to inner-case acoustic coupling, is similar to the phenomenon illustrated FIG. 1 in Embodiment 1; therefore, explanation for that will be omitted here.

The speaker-characteristic compensation circuit according to Embodiment 6 includes the first low-pass device for processing an input signal L to the second speaker 1L to create a cross component for the first speaker 1R and the second low-pass device for processing an input signal R to the first speaker 1R to create a cross component for the second speaker 1L.

Next, the operation of the speaker-characteristic compensation circuit will be explained. The input signal L to the second speaker 1L is inputted to the second adder 4L and to the first low-pass device. In the first low-pass device, the input signal L receives processing that is implemented through, e.g., a characteristic obtained by combining the characteristic of a low-pass filter and the characteristic −HLR/HRR. The processed signal outputted from the first low-pass device is inputted the first addition device 4R. The first addition device 4R adds the output signal from the first low-pass device to the input signal R to the first speaker 1R, thereby outputting a driving signal Rd for driving the first speaker 1R. Similarly, the input signal R to the first speaker 1R is inputted to the first adder 4R and to the first low-pass device. In the second low-pass device, the input signal R receives processing that is implemented through, e.g., a characteristic obtained by combining the characteristic of a LPF (low-pass filter) and the characteristic −HRL/HLL. The processed signal outputted from the second low-pass device is inputted the second addition device 4L. The second addition device 4L adds the output signal from the second low-pass device to the input signal L to the second speaker 1L, thereby outputting a driving signal Ld for driving the second speaker 1L.

According to Embodiment 6, acoustic coupling is cancelled, with regard to low-frequency signal components only. Accordingly, a sensation of enhancement in high-frequency components can be reduced that is caused by mismatching between signals for canceling the high-frequency signal components; an effect in which acoustic sound can comfortably be listened to can be demonstrated.

In addition, in Embodiment 6, constituent elements the same as or equivalent to those in Embodiment 1 of the present invention are denoted by the same reference characters, and explanations for those are omitted; thus, only different elements have been explained.

Additionally, the technique described in Embodiment 6 can be applied to the other embodiments than Embodiment 1.

Embodiment 7

In Embodiment 1, for processing steps to reduce crosstalks, the first and second processing devices 3LR and 3RL are utilized; however, in Embodiment 7, a case will be explained in which a correlation computation device 13, a control device 14, first switches 15LRa and 15LRb, second switches 15RLa and 15RLb, first and second signal processing devices 16LR and 16RL, which are described later, are utilized.

In addition, the phenomenon that a sound wave reproduced by one speaker leaks into the other speaker, due to inner-case acoustic coupling, is similar to the phenomenon illustrated FIG. 1 in Embodiment 1; therefore, explanation for that will be omitted here. Additionally, the respective additions in the first and second addition devices 4R and 4L are the same as those in Embodiment 1; therefore, explanations for those are omitted here.

Figure 7:
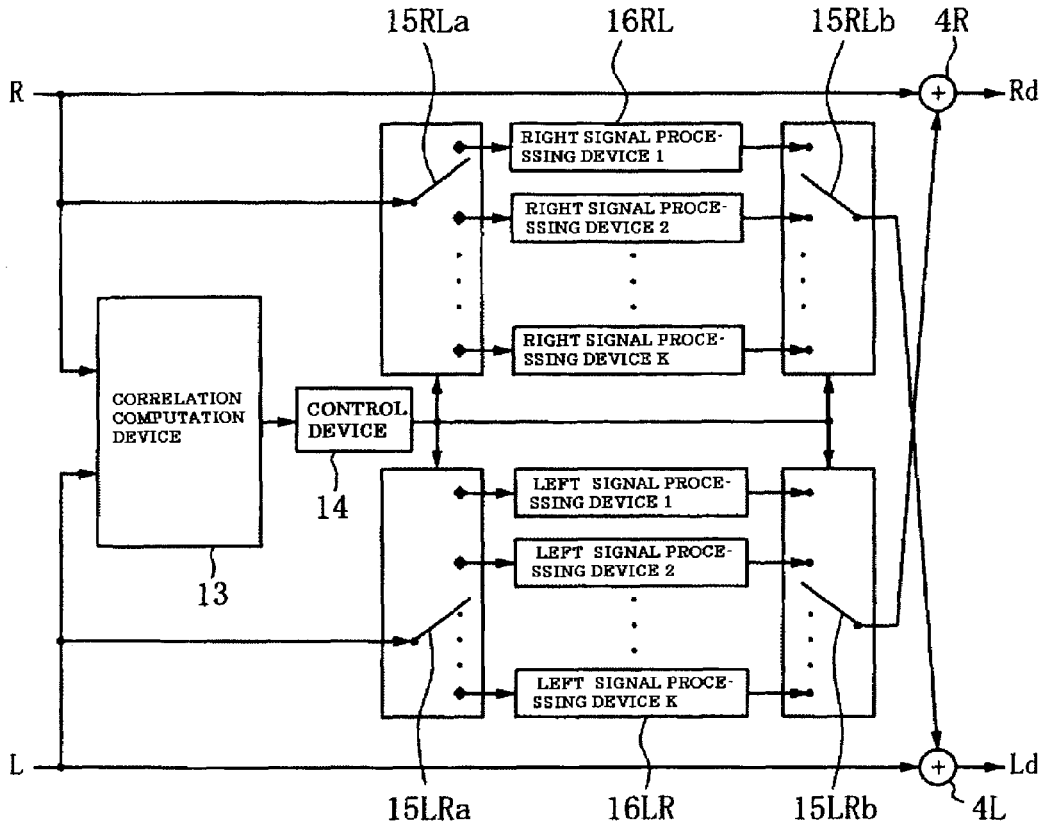
FIG. 7 is a conceptual diagram of a speaker-characteristic compensation circuit according to Embodiment 7.

FIG. 7 is a schematic diagram of a speaker-characteristic compensation circuit utilized in a mobile terminal device according to Embodiment 7 of the present invention. As illustrated in FIG. 7, the speaker-characteristic compensation circuit according to Embodiment 7 includes the correlation computation device 13 for computing, for each frequency component, the correlation between an input signal R to the first speaker 1R and an input signal L to the second speaker 1L, the control device 14 for controlling the first and second switches 15LR and 15RL, based on the correlation between the input signals R and L, and the first and second signal processing devices 16LR and 16RL. The first switch 15LR is connected with one of the first signal processing devices 16LR1 to 16LRK, and the second switch 15RL is connected with one of the second signal processing devices 16RL1 to 16RLK.

Next, the operation of the speaker-characteristic compensation circuit will be explained.

The input signal R to the first speaker 1R is inputted to the first adder 4R, to the second switch 15RLa, and to the correlation computation device 13. The input signal L to the second speaker 1L is inputted to the second adder 4L, to the second switch 15LRa, and to the correlation computation device 13. The correlation computation device 13 computes, for each frequency component, the correlation between the input signals R and L and inputs the result of the computation to the control device 14. The control device 14 to which the result of the computation is inputted switches the first switches 15LRa and 15LRb, and the second switches 15RLa and 15RLb, in accordance with the coefficient, for each frequency, of the correlation between the input signals R and L. For example, when the correlation for a specific bandwidth is high, the first switch 15LR or the second switch 15RL is controlled in such a way as to be connected with the signal processing device 16LR or the second signal processing device 16RL that makes the intensity of the signal component in the specific bandwidth zero. In some cases, the first signal processing device 16LR implements processing in which, e.g., the characteristic of −HLR/HRR is applied, after the intensity of the signal component in a specific bandwidth is made zero. In some cases, the first signal processing device 16RL implements processing in which, e.g., the characteristic of −HRL/HLL is applied, after the intensity of the signal component in a specific bandwidth is made zero.

Here, high correlation for a specific bandwidth signifies that, in the specific bandwidth, the respective signal components of the input signals L and R are approximately in-phase. In this situation, the processing for canceling acoustic coupling implements addition of an approximately reverse-phase signal to an original signal; therefore, the signal component in the high-correlation bandwidth is reduced, whereby deterioration in acoustic sensation is caused. However, according to the foregoing example, a zero-intensity signal is added to the signal component in a high-correlation bandwidth; therefore, an effect in which no foregoing deterioration in acoustic sensation occurs is demonstrated.

Moreover, because in-phase components are originally localized in the middle, the listener can obtain a good sound image even though, for the in-phase components, acoustic coupling is not cancelled.

In addition, in Embodiment 7, constituent elements the same as or equivalent to those in Embodiment 1 of the present invention are denoted by the same reference characters, and explanations for those are omitted; thus, only different elements have been explained.

Embodiment 8

Figure 8:
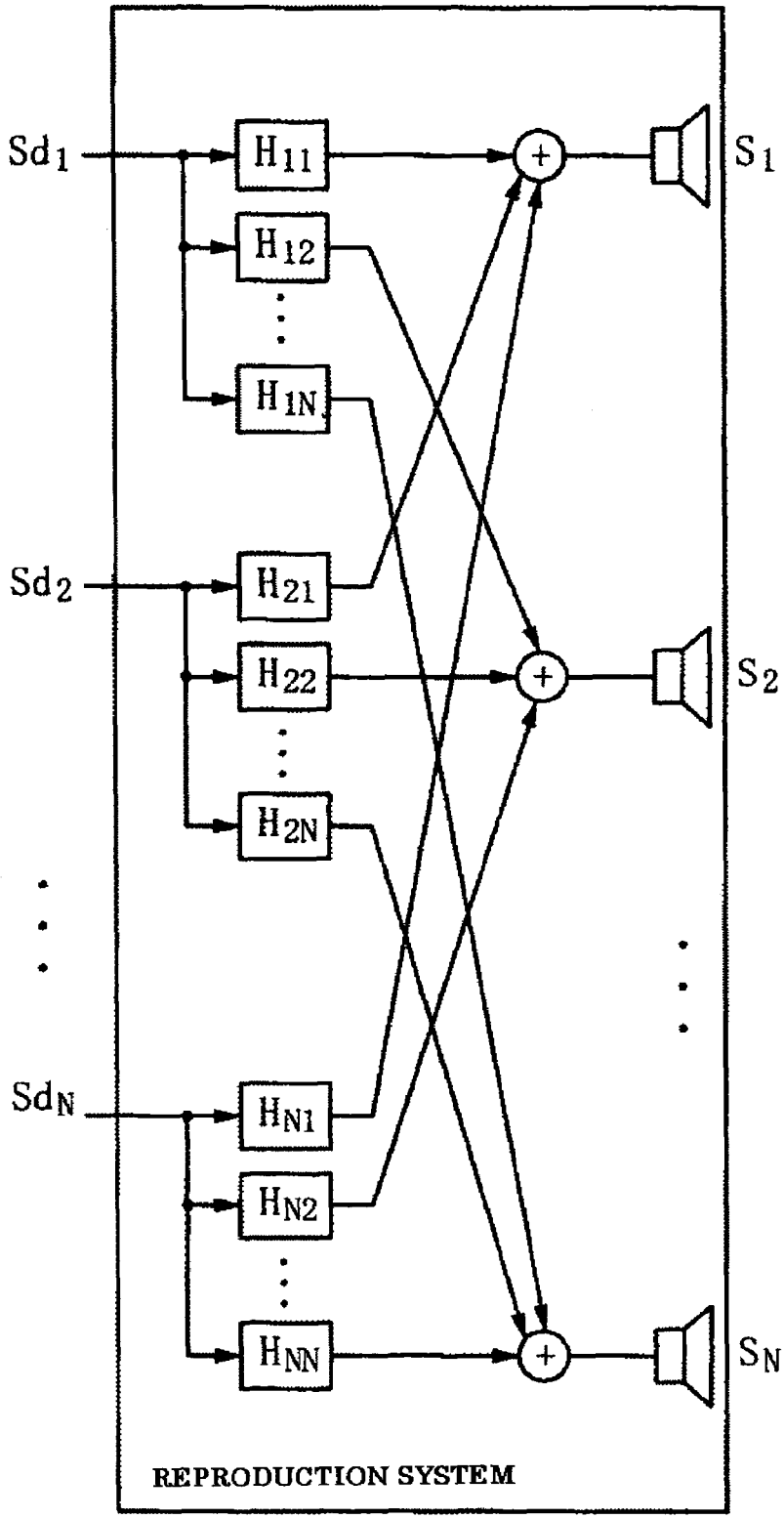
FIG. 8 is a diagram illustrating a reproduction model for a speaker reproduction system according to Embodiments 8.

FIG. 8 is a diagram illustrating a model for a reproduction system configured of a plurality of speakers. As illustrated in FIG. 8, because, in the reproduction system, N speakers share the back chamber, mutual acoustic coupling occurs in the case. The acoustic coupling is termed inner-case crosstalk component. Moreover, in the reproduction system, a characteristic is also considered in which a signal inputted to a channel in the reproduction system is directly transferred to the corresponding speaker and the signal is emitted from the speaker. The directly transferred signal is termed a direct component. In FIG. 8, the following reference characters are defined. Reference Character Sdi denotes a driving signal for driving i-th speaker in the reproduction system; Si, a speaker emission signal that is emitted from the i-th speaker in the reproduction system; Hii, a transfer characteristic in which the driving signal Sdi for the i-th channel is transformed through a speaker characteristic, an amplifier characteristic, acoustic coupling, and the like, and emitted from the i-th speaker; and Hij, a transfer characteristic in which the driving signal Sdi for the i-th channel is transformed through a speaker characteristic, an amplifier characteristic, acoustic coupling, and the like, and emitted from the j-th speaker.

The emission signal S emitted from the reproduction system in FIG. 8, the driving signal Sd for driving the speaker, and the transfer characteristic H are given by Equation 18.

$$S = [S_1, S_2, \cdots, S_N]^T \tag{18}$$

$$Sd = [Sd_1, Sd_2, \cdots, Sd_N]^T \tag{19}$$

$$H = \begin{bmatrix} H_{11}, H_{21}, \cdots, H_{N1} \\ H_{12}, H_{22}, \cdots, H_{N2} \\ \cdots \\ H_{1N}, H_{2N}, \cdots, H_{NN} \end{bmatrix} \tag{20}$$

From Equations 18 to 20, Equation 21 is yielded.

$$S = HSd \tag{21}$$

$$= \begin{bmatrix} H_{11}Sd_1 + H_{21}Sd_2 + \cdots + H_{N1}Sd_N \\ H_{12}Sd_1 + H_{22}Sd_2 + \cdots + H_{N2}Sd_N \\ \cdots \\ H_{1N}Sd_1 + H_{2N}Sd_2 + \cdots + H_{NN}Sd_N \end{bmatrix}$$

From Equation 21, it can be seen that the speaker emission signal Si includes inner-case crosstalk components from other channels.

Figure 9:
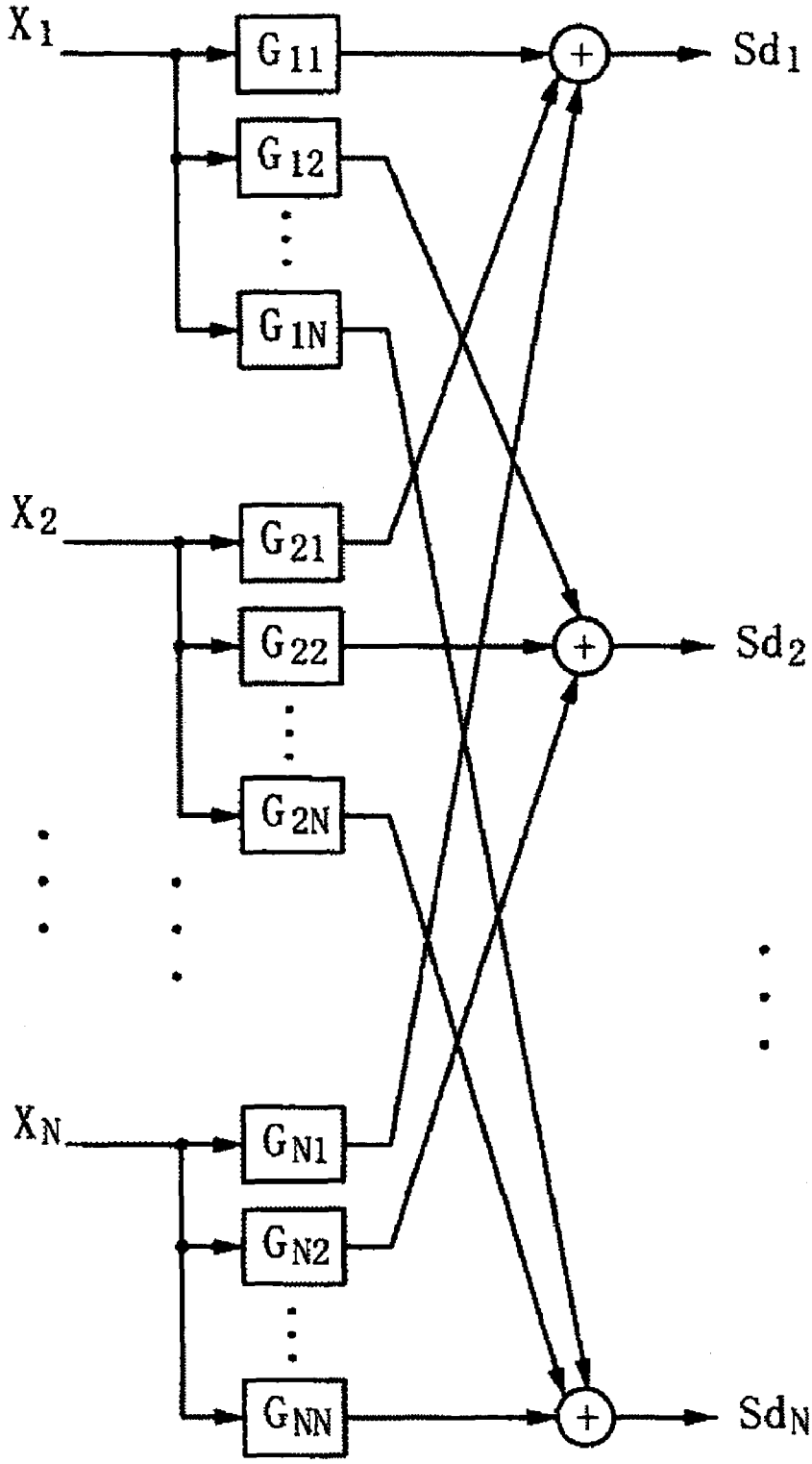
FIG. 9 is a conceptual diagram of a speaker-characteristic compensation circuit according to Embodiment 8.

FIG. 9 is a diagram illustrating processing that enables the inner-case crosstalk components represented by Equation 21 to be cancelled. An inner-case crosstalk canceling filter is provided in which an input signal Xi to a channel i is processed with a filter Gij, added to a channel j, and the resultant signal is multiplied by a scalar value σ. Here, let the input signal Xi and the filter Gij be represented by Equation 22 below:

$$X = [X_1, X_2, \cdots, X_N]^T \tag{22}$$

$$G = \begin{bmatrix} G_{11}, G_{21}, \cdots, G_{N1} \\ G_{12}, G_{22}, \cdots, G_{N2} \\ \cdots \\ G_{1N}, G_{2N}, \cdots, G_{NN} \end{bmatrix}$$

From Equation 22, it can be assumed that the filter characteristic of G is represented, for example, by Equation 23 below:

$$G = \begin{bmatrix} Q_{11}, Q_{12}, \cdots, Q_{1N} \\ Q_{21}, Q_{22}, \cdots, Q_{2N} \\ \cdots \\ Q_{N1}, Q_{N2}, \cdots, Q_{NN} \end{bmatrix} \tag{23}$$

where Qij is the cofactor of the (i, j) component of a matrix H Processing with the configuration in FIG. 9 yields the following equation:

$$S = \sigma HGX \tag{24}$$

$$= \sigma \begin{bmatrix} H_{11}, H_{21}, \cdots, H_{N1} \\ H_{12}, H_{22}, \cdots, H_{N2} \\ \cdots \\ H_{1N}, H_{2N}, \cdots, H_{NN} \end{bmatrix} \begin{bmatrix} Q_{11}, Q_{12}, \cdots, Q_{1N} \\ Q_{21}, Q_{22}, \cdots, Q_{2N} \\ \cdots \\ Q_{N1}, Q_{N2}, \cdots, Q_{NN} \end{bmatrix} \begin{bmatrix} X_1 \\ X_2 \\ \cdots \\ X_N \end{bmatrix}$$

$$= \sigma \begin{bmatrix} DetH, 0, \cdots, 0 \\ 0, DetH, 0, \cdots, 0 \\ \cdots \\ 0, \cdots, 0, DetH \end{bmatrix} \begin{bmatrix} X_1 \\ X_2 \\ \cdots \\ X_N \end{bmatrix}$$

$$= \sigma \begin{bmatrix} DetH \cdot X_1 \\ DetH \cdot X_2 \\ \cdots \\ DetH \cdot X_N \end{bmatrix}$$

$$= \sigma DetH \cdot X$$

where "DetH" is a constant having a frequency characteristic; thus, it can be seen that, even though a characteristic DetH is added to the emission signal S that, after receiving processing in FIG. 2, is emitted from the speaker, inner-case crosstalk components are completely removed from the emission signal S. In the case where the emission signal S should completely coincide with the input signal X, as many filters, having a characteristic 1/σ·DetH, as the number of speakers, i.e., N filters may be provided at the stage before or after the processing stage in FIG. 8.

In addition, in the case where the transfer characteristics Hii and Hij are equal to each other or approximate each other enough to be regarded as equal, it is possible to assume that Hii=HD and Hij=HX. Accordingly, for example, in the case where speakers are symmetrically provided in a mobile terminal device, making transfer characteristics equal reduces production costs.

A case where three speakers exist will specifically be explained below. In the first place, in the case where three speakers exist, the signal S emitted from the reproduction system, the driving signal Sd for driving the speaker, and the transfer characteristic Hare given by the following equation:

$$S = [S_1, S_2, S_3]^T \tag{25}$$

$$Sd = [Sd_1, Sd_2, Sd_3]^T \tag{26}$$

$$H = \begin{bmatrix} H_{11}, H_{21}, H_{31} \\ H_{12}, H_{22}, H_{32} \\ H_{13}, H_{23}, H_{33} \end{bmatrix} \tag{27}$$

In this situation, it can be seen that the speaker emission signal S is given by the following equation and includes inner-case crosstalk components from other channels:

$$S = HSd \tag{28}$$

$$= \begin{bmatrix} H_{11}Sd_1 + H_{21}Sd_2 + H_{31}Sd_3 \\ H_{12}Sd_1 + H_{22}Sd_2 + H_{32}Sd_3 \\ H_{13}Sd_1 + H_{23}Sd_2 + H_{33}Sd_3 \end{bmatrix}$$

Now, the filter characteristic of G is considered as follows:

$$G = \begin{bmatrix} Q_{11}, Q_{12}, Q_{13} \\ Q_{21}, Q_{22}, Q_{23} \\ Q_{31}, Q_{32}, Q_{33} \end{bmatrix} \tag{29}$$

The filter characteristic of G is assumed as Equation 29, where Qij is the cofactor of the (i, j) component of a matrix H. Processing with the configuration in FIG. 9 yields the following equation:

$$S = \sigma HGX \tag{30}$$

$$= \sigma \begin{bmatrix} H_{11}, & H_{21}, & H_{31} \\ H_{12}, & H_{22}, & H_{32} \\ H_{13}, & H_{23}, & H_{33} \end{bmatrix} \begin{bmatrix} Q_{11}, & Q_{12}, & Q_{13} \\ Q_{21}, & Q_{22}, & Q_{23} \\ Q_{31}, & Q_{32}, & Q_{33} \end{bmatrix} \begin{bmatrix} X_1 \\ X_2 \\ X_3 \end{bmatrix}$$

$$= \sigma \begin{bmatrix} DetH, 0, 0 \\ 0, DetH, 0 \\ 0, 0, DetH \end{bmatrix} \begin{bmatrix} X_1 \\ X_2 \\ X_3 \end{bmatrix}$$

-continued $$= \sigma \begin{bmatrix} DetH \cdot X_1 \\ DetH \cdot X_2 \\ DetH \cdot X_3 \end{bmatrix}$$

$$= \sigma DetH \cdot X$$

Accordingly, it can be seen that, even though a characteristic σ·DetH is added to the emission signal S emitted from the speaker, inner-case crosstalk components are completely removed from the emission signal S.

FIG. 9 is a block diagram illustrating the foregoing processing. In the case where the emission signal S emitted from a speaker should completely coincide with the input signal X, as many filters, having a characteristic 1/σ·DetH, as the number of speakers, i.e., 3 filters may be provided at the stage before or after the processing stage in FIG. 3.

What is claimed is:

1. A speaker-characteristic compensation method for a speaker reproduction system having at least two speakers in a case, the method comprising, for input signals to the speakers, a process of reducing crosstalk that, within the ease, occurs between the speakers:

a first direct processing step of processing an input signal to be a direct component to the other speaker;

a first cross processing step of processing an input signal to the one speaker, thereby obtaining a cross component to the other speaker;

a first addition step of adding respective signals obtained through the first direct processing step and the first cross processing step, thereby creating a driving signal for driving the other speaker;

a second direct processing step of processing an input signal to be a direct component to the one speaker;

a second cross processing step of processing an input signal to the other speaker, thereby obtaining a cross component to the one speaker; and a second addition step of adding respective signals obtained through the second direct processing step and the second cross processing step, thereby creating a driving signal for driving the one speaker;

wherein the first direct processing step is based on a transfer characteristic through which a driving signal for driving the one speaker is transformed by at least an amplifier characteristic or a speaker characteristic and emitted from the one speaker, the first cross processing step is based on a transfer characteristic through which a driving signal for driving the one speaker is transformed by at least inner case acoustic coupling and emitted from the other speaker, the second direct processing step is based on a transfer characteristic through which a driving signal for driving the other speaker is transformed by at least an amplifier characteristic or a speaker characteristic and emitted from the other speaker, and the second cross processing step is based on a transfer characteristic through which a driving signal for driving the other speaker is transformed by at least inner case acoustic coupling and emitted from the one speaker.

2. The speaker-characteristic compensation method according to claim 1, wherein the process includes a step of adding to an input signal to the other speaker a reduction signal for reducing a sound that, within the case, leaks from the one speaker into the other speaker.

3. The speaker-characteristic compensation method according to claim 2, wherein the reduction signal is created through processing of an input signal to the one speaker.

4. The speaker-characteristic compensation method according to claim 3, wherein an input signal to the one speaker is processed based on a characteristic obtained by dividing a transfer characteristic, through which a driving signal for driving the one speaker is transformed by at least acoustic coupling and emitted from the other speaker, by a transfer characteristic, through which a driving signal for driving the other speaker is transformed by at least an amplifier characteristic or a speaker characteristic and emitted from the other speaker, and by reversing the sign of said characteristic.

5. The speaker-characteristic compensation method according to claim 1, comprising a post-processing step of further processing a signal, to the other speaker, that has been obtained through addition in the first addition step, in order that a speaker emission signal emitted from the other speaker coincides in amplitude or phase with an input signal to the other speaker.

6. The speaker-characteristic compensation method according to claim 1, comprising a pre-processing step of, prior to the first direct processing step and the first cross processing step, processing an input signal to the other speaker so that a speaker emission signal emitted from the other speaker coincides in amplitude or phase with the input signal to the other speaker.

7. The speaker-characteristic compensation method according to claim 3, wherein an input signal to the one speaker is processed per subband of the input signal to the one speaker.

8. The speaker-characteristic compensation method according to claim 4, wherein an input signal to the one speaker is processed based on a characteristic obtained by adding a low-pass filter to said characteristic.

9. The speaker-characteristic compensation method according to claim 3, wherein an input signal to the one speaker is processed in accordance with the correlation between the input signal to the one speaker and an input signal to the other speaker, the correlation being obtained per frequency component.

10. The speaker-characteristic compensation method according to claim 3, wherein an input signal to the one speaker is processed based on a characteristic obtained by multiplying by a scalar value of smaller than one the input signal to the one speaker and reversing the sign of the resultant signal.

11. The speaker-characteristic compensation method according to claim 1, wherein the direct processing steps for the other and the one speaker or the cross processing steps for the other and the one speaker are approximately equivalent.

12. A speaker reproduction system having at least two speakers in a case, comprising, for input signals to the speakers, a processing means for reducing crosstalk that, within the case, occurs between the speakers:

a first direct processing means for processing an input signal to be a direct component to the other speaker;

a first cross processing means for processing an input signal to the one speaker, thereby obtaining a cross component to the other speaker;

a first addition means for adding respective signals obtained through the first direct processing and the first cross processing, thereby creating a driving signal for driving the other speaker;

a second direct processing means for processing an input signal to be a direct component to the one speaker; and a second cross processing means for processing an input signal to the other speaker thereby obtaining a cross component to the one speaker;

wherein the first direct processing means is based on a transfer characteristic through which a driving signal for driving the one speaker is transformed by at least an amplifier characteristic or a speaker characteristic and emitted from the one speaker, the first cross processing means is based on a transfer characteristic through which a driving signal for driving the one speaker is transformed by at least inner case acoustic coupling and emitted from the other speaker, wherein the second direct processing means is based on a transfer characteristic through which a driving signal for driving the other speaker is transformed by at least an amplifier characteristic or a speaker characteristic and emitted from the other speaker, and the second cross processing means is based on a transfer characteristic through which a driving signal for driving the other speaker is transformed by at least inner case acoustic coupling and emitted from the one speaker.

13. The speaker reproduction system according to claim 12, wherein the processing means adds a reduction signal for reducing a sound that, within the case, leaks from the one speaker into the other speaker to an input signal to the other speaker.

14. The speaker reproduction system according to claim 13, wherein the reduction signal is created through processing of an input signal to the one speaker.

15. The speaker reproduction system according to claim 14, wherein an input signal to the one speaker is processed based on a characteristic obtained by dividing a transfer characteristic, through which a driving signal for driving the one speaker is transformed by at least acoustic coupling and emitted from the other speaker, by a transfer characteristic, through which a driving signal for driving the other speaker is transformed by at least an amplifier characteristic and a speaker characteristic and emitted from the other speaker, and by reversing the sign of said characteristic.

16. The speaker reproduction system according to claim 12, comprising a post-processing means for further processing a signal, to the other speaker, which has been obtained through addition by the first addition means, in order that a speaker emission signal emitted from the other speaker coincides in amplitude or phase with an input signal to the other speaker.

17. The speaker reproduction system according to claim 12, comprising a pro-processing means for, prior to the first direct processing and the first cross processing, processing an input signal to the other speaker so that a speaker emission signal emitted from the other speaker coincides in amplitude or phase with the input signal to the other speaker.

18. The speaker reproduction system according to claim 14, wherein an input signal to the one speaker is processed per subband of the input signal to the one speaker.

19. The speaker reproduction system according to claim 15, wherein an input signal to the one speaker is processed based on a characteristic obtained by adding a low-pass filter to said characteristic.

20. The speaker reproduction system according to claim 14, wherein an input signal to the one speaker is processed in accordance with the correlation between the input signal to the one speaker and an input signal to the other speaker, the correlation being obtained per frequency component.

21. The speaker reproduction system according to claim 14, wherein an input signal to the one speaker is processed based on a characteristic obtained by multiplying by a scalar value of smaller than one the input signal to the one speaker and reversing the sign of the resultant signal.

22. The speaker reproduction system according to claim 12, wherein the direct processing means for the other and the one speaker or the cross processing means for the other and the one speaker are approximately equivalent.

23. A speaker-characteristic compensation method, for a speaker reproduction system having N speakers contained in a case, in which a speaker emission signal Si emitted from i-th speaker is given by Equation 31, by means of a matrix H including a transfer characteristic Hij through which a driving signal Sdi for driving the i-th speaker is transformed by at least inner-case acoustic coupling and emitted from j-th speaker, and a transfer characteristic Hii through which a driving signal Sdi for driving the i-th speaker is transformed by at least an amplifier characteristic or a speaker characteristic and emitted from the i-th speaker, $$\begin{bmatrix} S_1 \\ S_2 \\ \cdots \\ S_N \end{bmatrix} = HSd = \begin{bmatrix} H_{11}, & H_{21}, & \cdots, & H_{N1} \\ H_{12}, & H_{22}, & \cdots, & H_{N2} \\ \cdots & & & \\ H_{1N}, & H_{2N}, & \cdots, & H_{NN} \end{bmatrix} \begin{bmatrix} Sd_1 \\ Sd_2 \\ \cdots \\ Sd_N \end{bmatrix} \tag{31}$$

wherein the driving signal Sdi for the i-th speaker is created by processing an input signal Xi for the i-th speaker with a filter characteristic G, given by Equation 32, that is based on a cofactor Qij of an (i, j) component of the matrix H $$\begin{bmatrix} Sd_1 \\ Sd_2 \\ \cdots \\ Sd_N \end{bmatrix} = G \begin{bmatrix} X_1 \\ X_2 \\ \cdots \\ X_N \end{bmatrix} \tag{32}$$

$$\text{where } G = a \begin{bmatrix} Q_{11}, & Q_{12}, & \cdots, & Q_{1N} \\ Q_{21}, & Q_{22}, & \cdots, & Q_{2N} \\ \cdots & & & \\ Q_{N1}, & Q_{N2}, & \cdots, & Q_{NN} \end{bmatrix}.$$

24. A speaker reproduction system, having N speakers contained in a case in which a speaker emission signal Si emitted from i-th speaker is given by Equation 33, by means of a matrix H including a transfer characteristic Hij through which a driving signal Sdi for driving the i-th speaker is transformed by at least inner-case acoustic coupling and emitted from j-th speaker, and a transfer characteristic Hii through which a driving signal Sdi for driving the i-th speaker is transformed by at least an amplifier characteristic or a speaker characteristic and emitted from the i-th speaker, $$\begin{bmatrix} S_1 \\ S_2 \\ \cdots \\ S_N \end{bmatrix} = HSd = \begin{bmatrix} H_{11}, & H_{21}, & \cdots, & H_{N1} \\ H_{12}, & H_{22}, & \cdots, & H_{N2} \\ \cdots & & & \\ H_{1N}, & H_{2N}, & \cdots, & H_{NN} \end{bmatrix} \begin{bmatrix} Sd_1 \\ Sd_2 \\ \cdots \\ Sd_N \end{bmatrix} \tag{33}$$

wherein The driving signal Sdi for the i-th speaker is created by processing an input signal Xi for the i-th speaker with a filter characteristic G, given by Equation 34, that is based on a cofactor Qij of an (i, j) component of the matrix H $$\begin{bmatrix} Sd_1 \\ Sd_2 \\ \cdots \\ Sd_N \end{bmatrix} = G \begin{bmatrix} X_1 \\ X_2 \\ \cdots \\ X_N \end{bmatrix} \tag{34}$$

$$\text{where } G = a \begin{bmatrix} Q_{11}, & Q_{12}, & \cdots, & Q_{1N} \\ Q_{21}, & Q_{22}, & \cdots, & Q_{2N} \\ \cdots & & & \\ Q_{N1}, & Q_{N2}, & \cdots, & Q_{NN} \end{bmatrix}.$$

* * * * *